US009550292B1

(12) United States Patent
Putila

(10) Patent No.: US 9,550,292 B1
(45) Date of Patent: Jan. 24, 2017

(54) WALL MOUNTED TOOL RACK

(71) Applicant: Joseph J Putila, Carmichaels, PA (US)

(72) Inventor: Joseph J Putila, Carmichaels, PA (US)

(73) Assignee: Gerome Manufacturing Co., Inc., Smithfield, PA (US)

( * ) Notice: Subject to any disclaimer, the term of this patent is extended or adjusted under 35 U.S.C. 154(b) by 0 days.

(21) Appl. No.: 14/979,690

(22) Filed: Dec. 28, 2015

(51) Int. Cl.

| | |
|---|---|
| ***B25H 3/04*** | (2006.01) |
| ***A47F 7/00*** | (2006.01) |
| ***A47F 5/08*** | (2006.01) |
| ***A47F 5/10*** | (2006.01) |

(52) U.S. Cl.
CPC ..... *B25H 3/04* (2013.01); *A47F 5/0823* (2013.01); *A47F 5/105* (2013.01); *A47F 7/0021* (2013.01)

(58) Field of Classification Search
CPC ..... B25H 3/04; A47F 5/105; A47F 7/0021; A47F 5/0823
USPC ..... 211/70.6
See application file for complete search history.

(56) References Cited

U.S. PATENT DOCUMENTS 1,044,381 A * 11/1912 Harr ..... A47F 7/163 211/169
1,116,484 A * 11/1914 Ralph ..... A47F 5/02 211/169
1,240,611 A * 9/1917 Smith ..... A47G 25/0685 211/48
2,144,083 A * 1/1939 Rentfrow, Sr. ..... E04H 1/12 297/158.1
2,162,919 A * 6/1939 McAuliffe ..... A47F 7/24 211/96
2,339,627 A 4/1941 Edison
2,804,212 A * 8/1957 Spitzig ..... B42F 15/0005 211/169
2,928,555 A * 3/1960 Childs ..... H05K 7/16 211/168
3,017,999 A * 1/1962 Cano ..... G11B 33/0466 211/169
3,333,711 A * 8/1967 Helmer ..... A47G 25/0685 211/96
3,391,796 A 7/1968 Cross
3,514,883 A 6/1970 Albright
4,426,007 A * 1/1984 Beleckis ..... B42F 5/005 211/169
5,139,155 A 8/1992 Laxson
5,740,910 A 4/1998 Ueng
5,746,330 A 5/1998 DiBetta
5,899,343 A * 5/1999 Franklin ..... A47F 7/02 211/85.2
5,984,441 A 11/1999 Stokhuijzen
(Continued)

*Primary Examiner* — Korie H Chan
(74) *Attorney, Agent, or Firm* — Cohen & Grigsby, P.C.

(57) ABSTRACT

A wall mounted tool rack having a plurality of pivotally attachable panels is disclosed. The tool rack includes an open rectangular frame mountable on a vertical wall, wherein the frame includes a number of horizontal mounting apertures which are spaced to match a spacing of a wall stud and accept a fastener used to mount the frame flush to the vertical wall, and a number of pivot apertures. The pivot apertures accept top and bottom pins of a mounting rail which is attached to a panel, and allows the panel to rotate about a vertical axis through at least 120 degrees of rotation. The panels may be composed of peg-board and may accept mounting clips which provide a means to attach or hang tools of different sizes, shapes, and weights to the panel.

19 Claims, 6 Drawing Sheets

(56) References Cited

U.S. PATENT DOCUMENTS

| | | | | |
|---|---|---|---|---|
| 6,394,291 | B2 | 5/2002 | Maier-Hunke | |
| 6,826,858 | B1 * | 12/2004 | Muller | A47G 1/17 211/169 |
| 8,469,208 | B2 * | 6/2013 | O'Day | A47F 7/163 211/169 |
| 2007/0068887 | A1 | 3/2007 | Nawrocki | |

* cited by examiner

WALL MOUNTED TOOL RACK

FIELD OF THE INVENTION

The present invention relates generally to a wall mounted storage system, and more specifically to a storage system which includes a rectangular mounting frame attachable to a wall at the studs, and a plurality of removable panels pivotally attached to the frame which provide compact storage for a large number of items.

BACKGROUND OF THE INVENTION

Storage and organization of tools and other equipment is important to job efficiency, allowing quick and convenient retrieval of a specific tool when needed. Hanging objects from peg boards is a common method for storing items such as tools in an organized, easily visible manner. In fact, workshops and even home garages often include peg board walls for storing tools and other equipment. While convenient, such means for storage requires a large amount of wall space and can make retrieval of an item difficult and/or time consuming as a user walks to and fro retrieving different items.

Various prior art solutions have been suggested which provide storage for items on a plurality of pivotally attached panels. For example, U.S. Pat. No. 5,139,155 discloses a system which includes a plurality of panels that are set into channels running along the floor and ceiling so that the panels may rotate on a vertical axis centered along a side edge of each panel. While such a solution does provide a large amount of surface area for storage of a number of items, much of the storage space is either near the floor or ceiling. Furthermore, this solution still occupies a fair amount of space in a workshop or home garage as it requires installation of channels along both the floor and ceiling.

U.S. Pat. No. 5,984,441 discloses smaller wall mounted tool holding modules which may be individually attached to a wall, or may be coupled to adjacent modules to make a portable tool chest. The tools are positioned and held between spring loaded clamps on each panel, which also retain the tools securely during transport of the modules when coupled as a portable tool chest. While this solution provides a compact means for storing and transporting smaller tools, this latter function as a tool chest puts limits on the size of each panel and thus the number, weight, and size of the tools that may be stored (i.e., limited carrying capacity of a user). Furthermore, each tool is stored in a specific location between the spring loaded clamps, so placement of additional tools is not straightforward and often not possible as the clamps may not accept certain type of tools.

Alternatively, U.S. Pat. No. 5,740,910 discloses a wheeled tool box which encloses a plurality of pivotally mounted panels for attaching tools. Since these panels are positioned within the tool box, each panel will have a limited range of motion, making it difficult to see or access many areas of the panels (e.g., tools stored near the back of the panels). Furthermore, the size of the tool chest places a limit on the number and size of the panels that may be used to store tools, and on the number and size of the tools that may be stored.

U.S. Pat. No. 5,746,330 discloses a tool rack assembly that may be placed on a work bench which includes a number of pivotally attached peg-board panels useful for storing tools. The bulky design of the disclosed frame precludes a large range of motion for the panels, and additional spacer rods further limit this range of motion. Furthermore, the mounting means for pivotal attachment of the panels to the frame requires more than one peg board per panel, increasing the overall weight and cost of the tool rack. And finally, the tool rack is limited to placement on a bench, table or shelf that is positioned against a wall as the overall weight of the tool rack necessitates additional support through attachment to the wall.

Storage solutions for light weight items are prevalent, such as disclosed in U.S. Pat. Nos. 3,514,883, and 3,391,796, and 6,394,291. Each discloses a system for pivotally attaching a plurality of display panels about a vertical axis to a support frame. However, each solution is configured to hold and display only very lightweight panels and items, typically informational papers, posters, or pictures, and thus lack means to attach items such as tools to a panel, or means to support the weight and/or bulk of such items.

Thus, while several of these devices and systems disclose structures for holding items, none of the above storage solutions is designed to compactly store a large number of items such as tools in an economical and efficient manner.

SUMMARY OF THE INVENTION

The presently disclosed invention overcomes many of the shortcomings of the prior art by providing a compact storage system for a large number of items such as tools in an economical and efficient manner. Further, the compact storage system is easily installed on available wall space at a user defined height and location, and provides storage for tools which may vary in size, shape, and weight.

Thus, provided is a wall mounted tool rack comprising an open rectangular frame which is mountable flush with a vertical wall, and at least one panel pivotally and removeably attachable to the frame.

The frame may comprise top and bottom segments each having a base portion comprising at least two horizontal mounting apertures and a forward projection comprising a plurality of pivot apertures, and two side segments extending from the top segment to the bottom segment and spaced apart from each other. The forward projections of the top and bottom segments are attached to and extend horizontally from the base portions of the top and bottom segments.

The at least two horizontal mounting apertures are spaced to match a spacing of a wall stud and are sized to accept a fastener used to mount the frame to the vertical wall. Further, each of the side segments may comprise a plurality of vertical mounting apertures which are sized to accept the fastener used to mount the frame to the vertical wall.

The panel(s) may be removeably attachable to the frame by a mounting rail, which is attachable to a distal side of the panel and includes a top pin and a bottom pin. The top pin of the mounting rail is positionable within one of the plurality of pivot apertures in the forward projection of the top segment and the bottom pin of the mounting rail is positionable within an aligned one of the plurality of pivot apertures in the forward projection of the bottom segment. The top pin may be longer than the bottom pin to aid attachment of the panel to the frame.

The forward projections of the top and bottom segments extend horizontally beyond a horizontal profile of the side segments. As such, when a single panel is mounted, that panel may be rotatable about a vertical axis through at least 160 degrees of rotation, or even up to 180 degrees of rotation. When a plurality of panels are mounted on the open rectangular frame, each panel may be rotatable about the vertical axis through at least 120 degrees of rotation, such as at least 140 degrees of rotation. Such rotation is limited (i.e., to values less than 180 degrees of rotation) only by the number of panels mounted, and/or the number and size of items mounted on the panels.

The frame and the mounting rail may each comprise powder coated steel. Further, the panel(s) may comprise a plurality of regularly spaced peg holes, such as found in pegboard. An exemplary panel includes a sized piece of pegboard, which may be made of wood such as high density fiberboard or hardboard, composite material, plastic, or metal.

The mounting rail may be attached to the panel by at least two attachment means, such as by positioning each of the at least two attachment means through an attachment aperture in the mounting rail and an aligned one of a plurality of regularly spaced peg holes in the panel. Exemplary attachment means include nut and bolt sets, or rivets. When nut and bolt sets are used, the mounting rail may be removeably attachable to the panel.

Tools or other items may be attached to the panels of the wall mounted tool rack using at least one tool mounting element, which may be positionable within one or more of the plurality of regularly spaced peg holes.

The presently disclosed invention also provides a kit which may include the wall mounted frame, and a plurality of mounting rails with the associated attachment means useful for attaching the mounting rails to one or more panels. The kit may further include a plurality of panels, and a plurality of tool mounting elements for releasably attaching items such as tools to the panels. The panels may be sized portions of peg-board, and the tool mounting elements may be positionable within one or more of a plurality of regularly spaced peg holes found in the peg-board. The kit may further include a plurality of fasteners useful to mount the open rectangular frame flush with the vertical wall.

BRIEF DESCRIPTION OF THE DRAWINGS

Aspects, features, benefits and advantages of the embodiments herein will be apparent with regard to the following description, appended claims, and accompanying drawings. In the following figures, like numerals represent like features in the various views. It is to be noted that features and components in these drawings, illustrating the views of embodiments of the presently disclosed invention, unless stated to be otherwise, are not necessarily drawn to scale.

DETAILED DESCRIPTION

Figure 1:
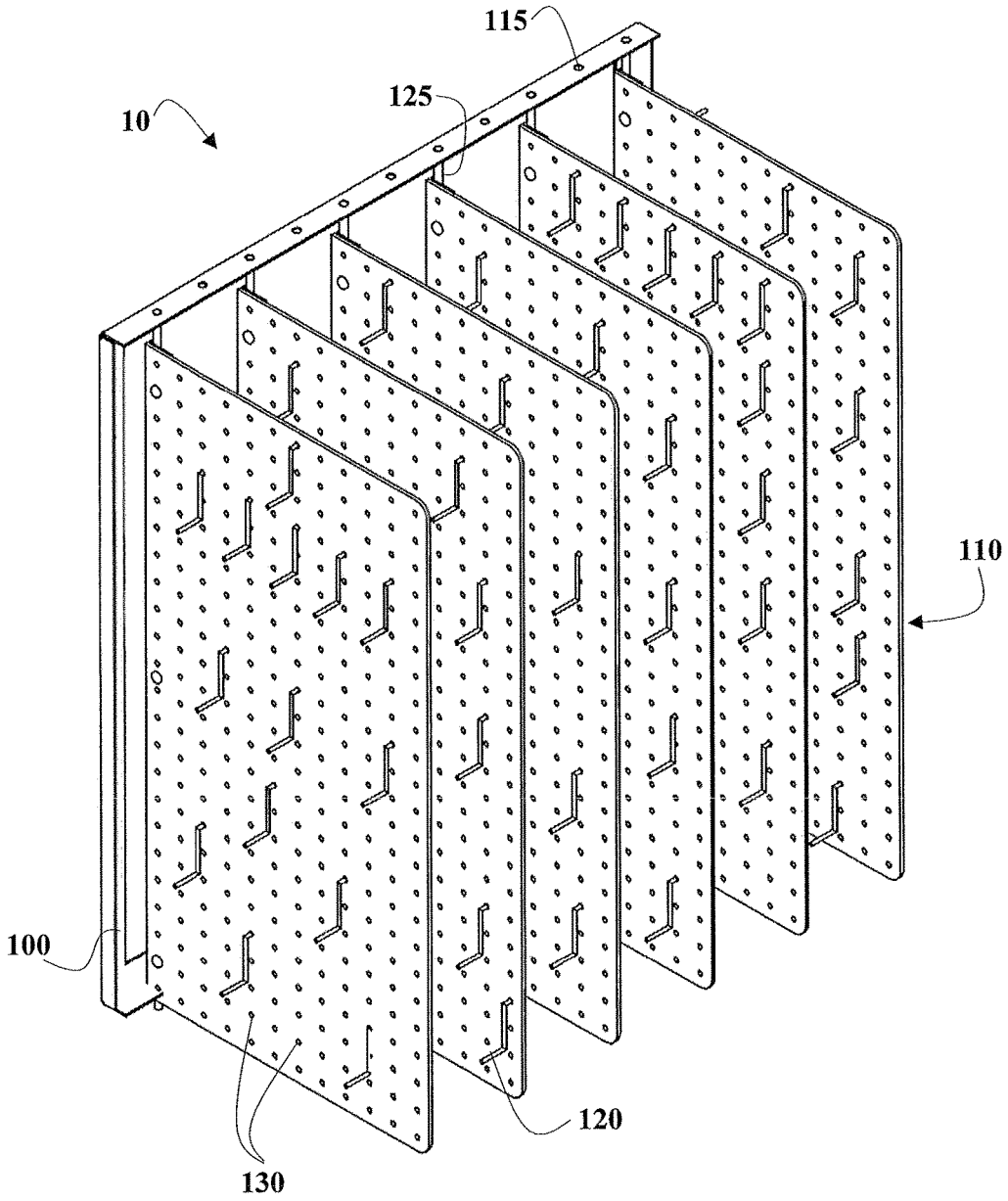
FIG. 1 illustrates a perspective view of a wall mounted tool rack in accordance with certain aspects of the presently disclosed invention.

In the following description, the present invention is set forth in the context of various alternative embodiments and implementations involving a wall mounted tool rack. While the following description discloses numerous exemplary embodiments, the scope of the present patent application is not limited to the disclosed embodiments, but also encompasses combinations of the disclosed embodiments, as well as modifications to the disclosed embodiments.

Various aspects of the wall mounted tool rack may be illustrated by describing components that are coupled, attached, and/or joined together. As used herein, the terms "coupled", "attached", and/or "joined" are interchangeably employed to indicate either a direct connection between two components or, where appropriate, an indirect connection to one another through intervening or intermediate components. In contrast, when a component is referred to as being "directly coupled", "directly attached", and/or "directly joined" to another component, there are no intervening elements shown in the examples.

Various aspects of the wall mounted tool rack may be illustrated with reference to one or more exemplary implementations. As used herein, the term "exemplary" means "serving as an example, instance, or illustration," and should not necessarily be construed as preferred or advantageous over other variations of the devices, systems, or methods disclosed herein. "Optional" or "optionally" means that the subsequently described event or circumstance may or may not occur, and that the description includes instances where the event occurs and instances where it does not. In addition, the word "comprising" as used herein means "including, but not limited to".

Relative terms such as "lower" or "bottom" and "upper" or "top" may be used herein to describe one element's relationship to another element illustrated in the drawings. It will be understood that relative terms are intended to encompass different orientations of aspects of the tool rack in addition to the orientation depicted in the drawings. By way of example, if aspects of the tool rack in the drawings are turned over, elements described as being on the "bottom" side of the other elements would then be oriented on the "top" side of the other elements as shown in the relevant drawing. The term "bottom" can therefore encompass both an orientation of "bottom" and "top" depending on the particular orientation of the drawing.

It must also be noted that as used herein and in the appended claims, the singular forms "a", "an", and "the" include the plural reference unless the context clearly dictates otherwise. For example, although reference is made to "a" panel, "an" attachment means, and "a" mounting rail, one or more of any of these components and/or any other components described herein can be used. Unless defined otherwise, all technical and scientific terms used herein have the same meanings as commonly understood by one of ordinary skill in the art.

Storage space in the average American home and/or work place is at a premium. Thus, storage systems that occupy a small amount of surface area, such as a small portion of a wall, and provide an efficient way in which to store a large number of items are highly desirable. The presently disclosed invention provides a wall mounted rack that compactly holds and stores a large number and variety of items such as tools. The tool rack may be mounted on any available wall space at a user defined height so that all of the items stored on the rack are easily accessible by the user. Furthermore, the presently disclosed invention is designed to be easily and securely installed by attachment to the wall at the studs so that storing heavy items does not pose a risk that the wall mounted rack may detach from the wall.

The wall mounted tool rack may be configured to accept any number of panels of any dimension. Thus, varied panel materials and configurations are possible on the same wall mounted tool rack. Furthermore, the user may attach fewer panels when less storage space is needed or more panels when more storage space is needed, and each panel need not have the same overall dimension. The overall construction of the frame and attachable panels is economical to produce and maintain should replacement parts be required.

Referring now to the drawings, various embodiments of a wall mounted tool rack according to the presently disclosed invention are shown in FIGS. 1 through 6 generally designated by reference number 10. FIG. 1 illustrates a perspective view of the wall mounted tool rack 10 as mounted on a vertical wall. The tool rack 10 comprises an open rectangular frame 100 which provides pivotal attachment for a plurality of panels 110.

The panels may comprise a plurality of regularly spaced holes or apertures, such as the peg holes 130 found on standard perforated hardboard (pegboard), which may be used to removeably attach items directly to the panel 110. Alternatively, items may be removeably attached to the panel using a tool mounting element 120, which may be attachable to the panel via one or more of the plurality of peg holes 130. The tool mounting element 120 may be any of a variety of simple hooks as shown in FIG. 1, or may comprise any of a number of well-known configurations designed to hold and/or secure various items onto a surface of a pegboard. Such tool mounting elements may be removeably attached to the pegboard so that they may be added, repositioned, exchanged, or removed to accommodate different storage configurations.

While the panels 110 are shown as having a plurality of regularly spaces holes or apertures, such as the peg holes 130 illustrated in FIG. 1, the panel may include any configuration or means for attaching items such as tools known in the art. For example, the panels 110 may comprise a regular or random pattern of holes, or may have a regular or random pattern of tool attachment elements positioned thereon. In this latter scenario, the tool attachment elements may include hooks, pegs, or other attachment means that are either removeably or semi-permanently attached to the panel (e.g., hooks which screw into the panel).

Figure 3:
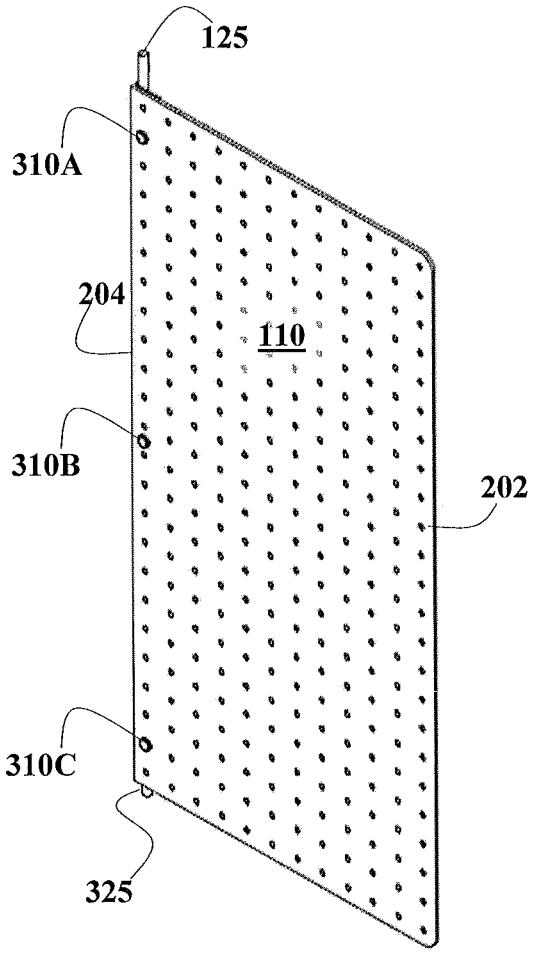
FIG. 3 illustrates a perspective view of a panel with the mounting rail attached in accordance with certain aspects of the presently disclosed invention.
Figures 4A, 4B:
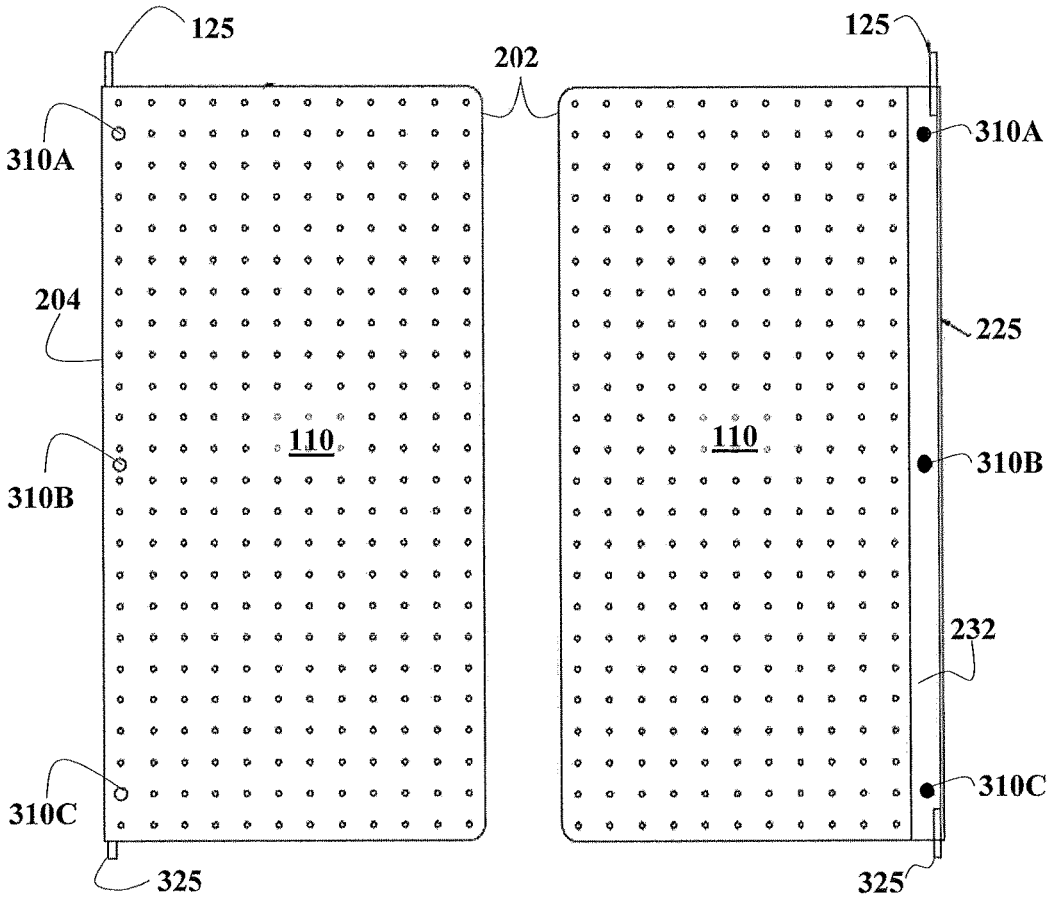
FIG. 4A illustrates a front view of the panel shown in FIG. 3.
FIG. 4B illustrates a back view of the panel shown in FIG. 3.
Figure 5:
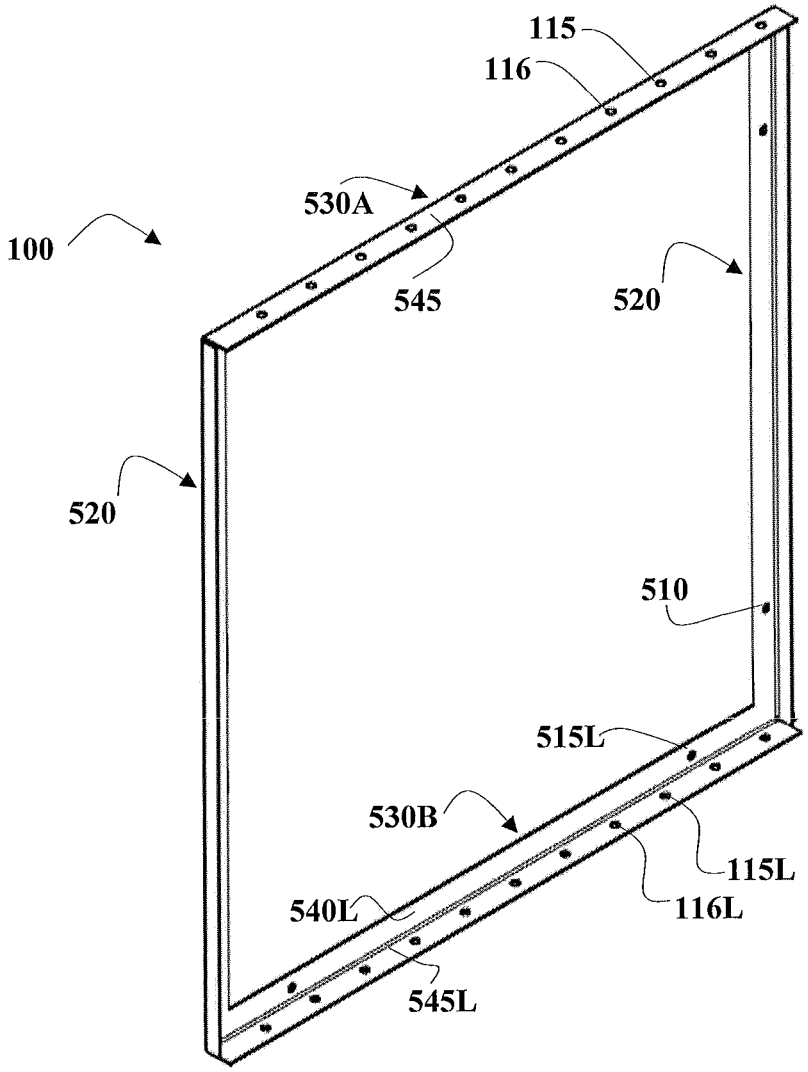
FIG. 5 illustrates a perspective view of the open rectangular frame of the wall mounted tool rack in accordance with certain aspects of the presently disclosed invention.

Each of the panels 110 may be removeably attached to the open rectangular frame 100 by a set of pivot pins which are positionable in pivot apertures in a top and bottom segment of the open rectangular frame 100 (only top pin 125 and top pivot aperture 115 are shown in FIG. 1; see also FIGS. 3 and 5). Each of the top and bottom pins may be connected or attached to the panel 110 by a mounting rail (225; see FIGS. 4A and 4B). As shown in FIG. 1, the panels 110 pivot about a vertical axis along a distal edge thereof (204; see FIG. 3) when attached to the frame 100.

Figure 2A:
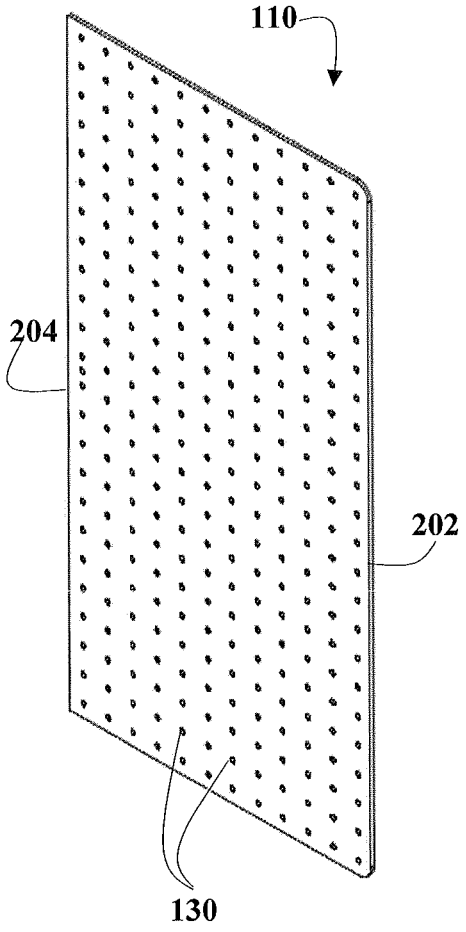
FIG. 2A illustrates a perspective view of a single panel of the wall mounted tool rack as shown in FIG. 1.
Figure 2B:
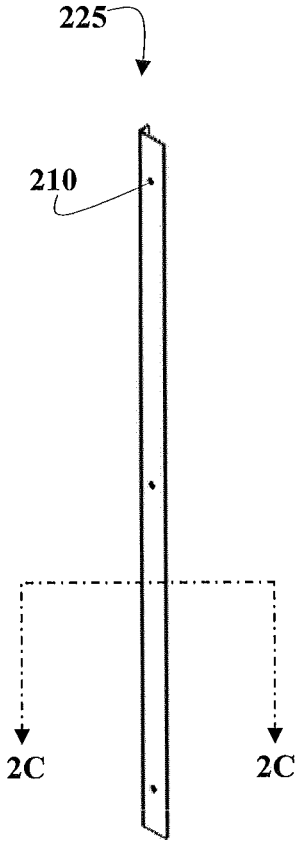
FIG. 2B illustrates a perspective view of a mounting rail without the top and bottom pins in accordance with certain aspects of the presently disclosed invention.

With reference to FIGS. 2A and 2B, the mounting rail 225 may be attached along, or proximal to, the distal edge 204 of the panel 110 using attachment means which may pass through attachment apertures 210 in the mounting rail. These attachment apertures 210 may be spaced to match a standard spacing of the plurality of holes in the panel (peg holes 130), or may be position according to any other scheme which may provide attachment of the mounting rail 225 to the edge of the panel 110. Further, while three mounting apertures 210 are shown in FIG. 2B, only two may be required to securely attach the mounting rail 225 to the panel 110. Thus, attachment of the mounting rail 225 to the panel 110 may be achieved using two or more mounting apertures 210 and attachment means, such as three or four or five mounting apertures 210 and associated attachment means. Also shown in FIG. 2A is a proximal side 202 of the panel 110.

With reference to FIG. 3, the mounting rail may be attached along one face of the panel 110 proximal to the distal edge 204 of the panel using any attachment means known in the art such as, for example, rivets or nut and bolt sets. Attachment means such as nut and bolt sets (310A, 310B, 310C) may allow removable attachment of the mounting rail 225 to the panel 110. In this way, should a panel be broken or damaged, or should a panel with a different profile (e.g., a change in size in any dimension) or formed of a different material be desired, the mounting rail 225 associated with the panel to be exchanged is removed and placed on a new replacement panel with ease. Alternately, attachment means such as rivets may be used to more permanently attach the mounting rail 225 to the panel 110.

Figure 2C:
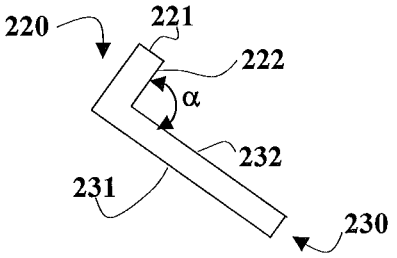
FIG. 2C illustrates a cross-sectional view taken along line 2C-2C of the mounting rail shown in FIG. 2B.

As shown by the cross sectional view in FIG. 2C, which is a cross section taken along line 2C-2C from FIG. 2B, the mounting rail 225 may be formed of an angled stock material and may thus comprise a short side 220 and a long side 230 attached to each other at an angle $\alpha$. Typically, the short side 220 and long side 230 of the mounting rail are attached to each other at an angle $\alpha$ of 90 degrees. The mounting rail 225 may be attached to the panel such that an outer surface 231 of the long side 230 contacts a face of the panel 110 proximal the distal edge 204 of the panel (see also FIG. 4B). When attached in this manner, the mounting rail 225 does not limit the thickness of the panel 110. As such, different panel materials may be selected for individual panels 110 within the same tool rack 10, or for all of the panels in the tool rack. For example, pegboard formed of metal typically has a thinner profile than pegboard formed of hardboard or composite materials. As designed, the mounting rail 225 may be used to attach any of these options, and others, to the open rectangular frame 100 presently disclosed.

The top and bottom pins (125, 325) of the mounting rail 225 may be permanently attached along an inner surface (222, 232) of one or both of the short side 220 and the long side 230 of the mounting rail 225, respectively (see FIGS. 3, 4A and 4B). For example, the top and bottom pins may be permanently attached to the mounting rail 225 by welding them to the corner formed by the attachment point between the short 220 and long 230 sides (i.e., contact point between inner surfaces 222 and 232). Alternately, the top and bottom pins may be permanently attached along an inner surface 222 of the short side 220 of the mounting rail 225, such as nearer to an edge 221 of the short side 220. Furthermore, the top and bottom pins (125, 325) may be attached to the mounting rail 225 though an attachment slot or pocket, or by welding. Alternatively, the top and bottom pins (125, 325) may be an integral part of the mounting rail 225, formed on production of the mounting rail.

The arrangement wherein the top and bottom pins (125, 325) are attached to the short side 220 of the mounting rail 225 somewhat offset from the long side 230 may allow the panels 110 to be pivoted to a storage position that is close to the vertical wall on which the open rectangular frame 100 is mounted (i.e., nearly flat on the wall). Such may provide for more compact storage of the tool rack 10 when empty and/or when the tool rack is provided for purchase by a consumer.

As shown in FIG. 4A, a front side of the panel 110 having the mounting rail attached proximal to the distal edge 204 leaves a majority of the panel face open and available for attachment of items. As shown in FIG. 4B, the mounting rail 225 lies along a back side of the panel 110, wherein an inner surface 232 of the long side 230 of the mounting rail 225 faces away from the back side of the panel 110. Top and bottom pins, 125 and 325 respectively, are shown. The top pin 125 may be longer than the bottom pin 325, to assist in easy installation of the panel in the pivot apertures on the open rectangular frame.

With continued reference to FIGS. 4A and 4B, each of the top and bottom pins (125 and 325, respectively) is dimensioned for insertion into the pivot apertures of the top and bottom segments (530A and 530B, respectively) of the frame 100. With reference to FIG. 5, the top pin 125 of the mounting rail is positionable within one of the plurality of pivot apertures (115, 116) in the forward projection 545 of the top segment 530A and the bottom pin 325 of the mounting rail is positionable within an aligned one of the plurality of pivot apertures (115L, 116L) in the forward projection 545L of the bottom segment 530B.

Any number of panels 110 may be pivotally attached to the frame 100 such as, for example, at least two. An exemplary number of panels 110 may be at least three panels, such as at least four or more panels. As shown in FIGS. 1 and 5, while six panels 110 are removeably attached to the frame 100, there are eleven pivot apertures provided in the forward projections (545 and 545L) of the top and bottom segments (530A and 530B, respectively) which could each accept a panel 110. The overall number of panels 110 and pivot apertures provided on a frame 100 is limited only by the frame dimensions, thickness of each panel, and/or number and size of the items stored on each panel 110. As such, the open rectangular frame 100 may be larger or smaller in either dimension (i.e., width or height), with mounting rails and panels sized accordingly, and the number and position of pivot apertures varied accordingly.

Figure 6:
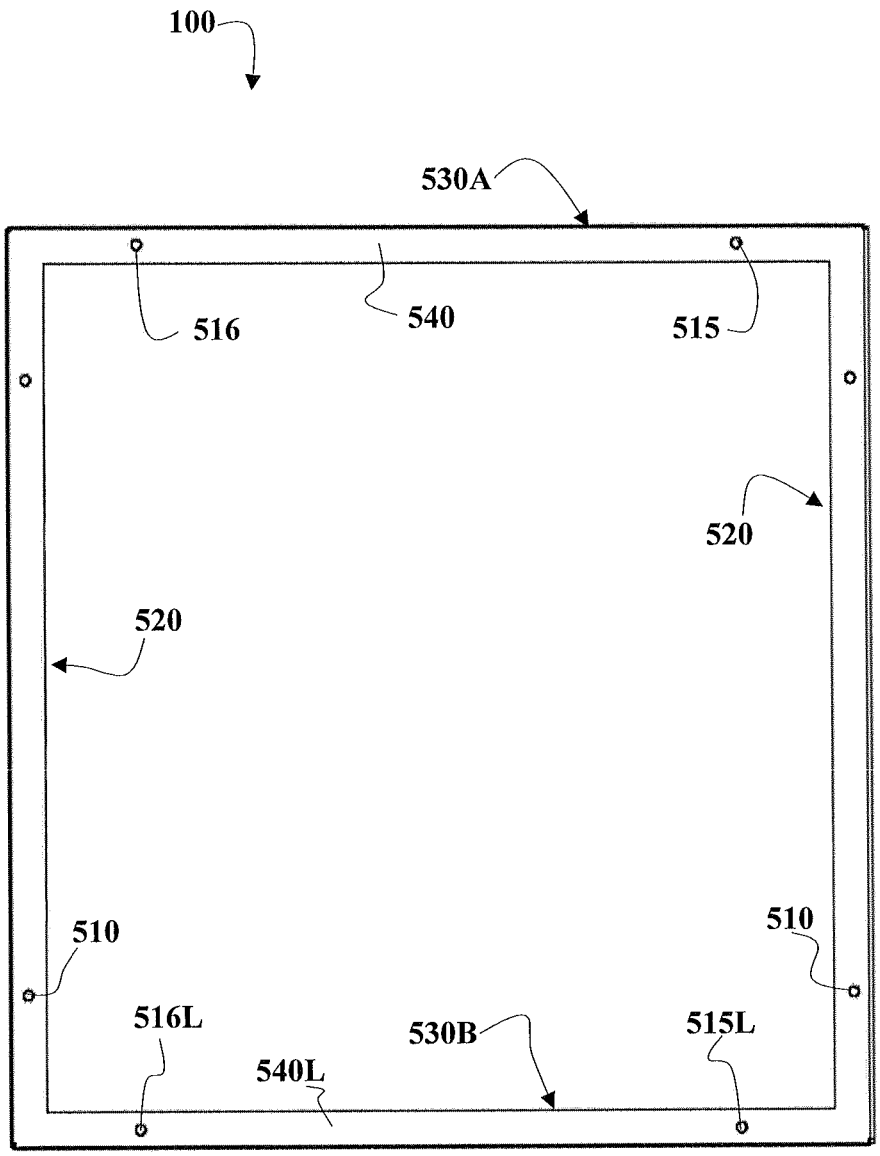
FIG. 6 illustrates a front view of the open rectangular frame shown in FIG. 5.

With reference to FIGS. 5 and 6, the wall mounted tool rack 10 of the present invention is shown as having an open rectangular frame with two horizontal segments (top and bottom, 530A and 530B, respectively) and two vertical segments 520. The top and bottom segments (530A, 530B) may each have a base portion (540, 540L) comprising a plurality of horizontal mounting apertures (only two shown; 516, 515) and a forward projection (545, 545L) comprising a plurality of pivot apertures (116, 115). Each of the two side segments 520 extend from the top segment 530A to the bottom segment 530B and are spaced apart from each other.

The forward projections (545, 545L) of the top and bottom segments (530A, 530B) are attached to and extend horizontally from the base portions (540, 540L) of the top and bottom segments. Additionally, the forward projections of the top and bottom segments extend horizontally beyond a horizontal profile of the side segments 520. As such, when a single panel 110 is mounted, that panel may be rotatable about a vertical axis through at least 160 degrees of rotation, or even up to 180 degrees of rotation. When a plurality of panels 110 are mounted on the open rectangular frame 100, each panel may be rotatable about the vertical axis through at least 120 degrees of rotation, such as at least 140 degrees of rotation. Such rotation is limited (i.e., to values less than 180 degrees of rotation) only by the number of panels mounted, and/or the number and size of items mounted on the panels.

The plurality of horizontal mounting apertures (only two shown; 516, 515) are spaced to match a spacing of a wall stud, typically 16 inches apart. Furthermore, the mounting apertures are sized to accept a fastener used to mount the frame 100 to the vertical wall. Each of the side segments may also comprise a plurality of vertical mounting apertures 510 which are sized to accept the fastener used to mount the frame to the vertical wall.

While only two mounting apertures are shown on each of the top, bottom, and side segments, any number of apertures may be formed. For example, the open rectangular frame may have horizontal mounting apertures formed thereon that are spaced much more closely than the spacing of a wall stud. These apertures may be labeled in pairs to indicate the pairs which are spaced according to the standard spacing of a wall stud to assist the user during installation. In this way, the user may mount the tool rack 10 on a vertical wall in a position that does not place the open rectangular frame 100 centered on a set of wall studs.

The number of mounting apertures, both horizontal and vertical, may be varied to accommodate a larger or smaller frame 100, as long as there are at least two horizontal mounting apertures on each of the top and bottom segments.

The frame 100 and the mounting rail 225 may each comprise a durable material such as a metal. An exemplary material includes powder coated steel. Further, as indicated above, the panel 110 may be formed of wood, plastic, metal, or any other sturdy composite material. The panel 110 may comprise a plurality of regularly spaced peg holes, such as found in pegboard. An exemplary panel 110 may include a sized piece of pegboard, which may be made of wood such as high density fiberboard or hardboard, composite material, plastic, or metal.

While shown and described as having an open rectangular frame 100 with top, bottom and side segments, the wall mounted tool rack 10 of the present invention may comprise additional horizontal and/or vertical segments which may provide additional support to the frame 100 when not installed on a vertical wall, or may provide additional points of attachment between the frame 100 and the wall on which it is installed. As long as the additional support does not interfere with the rotational movement of the panels 110 when attached to the frame 100, they are considered to be within the scope of the presently disclosed invention.

The presently disclosed invention also provides a kit which may include the wall mounted frame 100, and a plurality of mounting rails 225 with the associated attachment means useful for attaching the mounting rails to one or more panels. In this way, a user may attach the provided mounting rails 225 to panels which they have customized for their own particular uses.

The kit may include a plurality of panels 110, and a plurality of tool mounting elements 120 for releasably attaching items such as tools to the panels. As an example, the panels 110 provided in the kit may be sized portions of peg-board, and the tool mounting elements may be positionable within one or more of a plurality of regularly spaced peg holes found in the peg-board. The kit may further include a plurality of fasteners useful to mount the open rectangular frame flush with the vertical wall.

Having thus described the invention, the following examples are given as being illustrative thereof. All dimensions given in these examples are for illustration purposes only and should not be construed as limiting of the spirit or scope of the invention.

Example

A wall mounted tool rack as described hereinabove was produced. With reference to FIGS. 5 and 6, an open rectangular frame 100 was formed by welding top and bottom segments (530A and 530B, respectively) measuring 23 inches long to two side segments (520), each measuring 24.75 inches long. The top and bottom segments were formed using 1 inch×1 inch L angle 12G stainless steel, and the side segments were formed using 1 inch×0.625 inch L angle 12G stainless steel. The final frame was powder coated.

Two sets of aligned horizontal mounting apertures (516 and 515 in the top segment aligned with 516L and 515L in the bottom segment) were formed in the top and bottom segments (530A and 530B) along a base portion (540 and 540L, respectively) which lies flush with the vertical wall when the frame is mounted on the wall. The horizontal mounting apertures were spaced to match the spacing of a set of wall studs, 16 inches apart, and were centrally located on the width of the base portion of the top and bottom segments (0.5 inch—edge to center measurement).

A set of vertical mounting apertures (only one pointed out, 510) were formed in the side segments 520, also along a base portion which lies flush with the vertical wall when the frame is mounted on the wall. The vertical mounting apertures were also centrally located along the width of the base portion of the side segments (0.5—from edge to center measurement).

Pivot apertures (see for example 116 and 115 aligned with 116L and 115L, respectively) having a diameter of 0.265 inches were formed in a forward projection (545 and 545L) of the top and bottom segments (530A and 530B, respectively); 11 sets of aligned apertures which were spaced apart by 2 inches (center to center measurement). All of the pivot apertures were centrally located along the width of the forward projection (0.5—from edge to center measurement).

Panels were formed from perforated hardboard (standard pegboard) measuring 0.125 inches thick×12 inches wide×24 inches tall. The mounting rail was formed from 0.38 inch×1 inch L angled 12G stainless steel at a length of 24 inches. Three mounting apertures were formed in the long side of the L angle, each 0.166 inches in diameter and centered on the width of the mounting rail (0.5 inch—edge to center measurement).

Top and bottom pins (0.250 inch round stainless steel) were attached to a top and bottom end of the mounting rail by welding. The top pin (2 inches in length) extends past the top of the panel when the mounting rail is attached thereto by 1.1 inches, while the bottom pin (1.5 inches) extends past the bottom of the panel by 0.53 inches. Each mounting rail was also powder coated.

A total of six mounting rails were attached to six panels, each using three sets of nuts and bolts, or three sets of rivets (5/32×0.25 stainless steel rivet). Individual panels were mounted in the frame using aligned sets of the pivot apertures by first positioning the top pin in a pivot aperture of the top segment and then positioning the bottom pin in an aligned pivot aperture of the bottom segment. Because the top pin is longer than the bottom pin, when the panel is released to a resting position against the bottom segment, the top pin remains positioned within the top pivot aperture.

While the presently disclosed invention have been described in detail, it should be appreciated by those skilled in the art that various modifications and alternations and applications could be developed in light of the overall teachings of the disclosure. Accordingly, the particular arrangements, systems, apparatuses, and methods disclosed are meant to be illustrative only and not limiting as to the scope of the invention.

What is claimed is:

1. A wall mounted tool rack comprising:

an open rectangular frame mountable flush with a vertical wall, the frame comprising:

a top segment and a bottom segment each having a base portion comprising at least two horizontal mounting apertures and a forward projection comprising a plurality of pivot apertures, wherein the at least two horizontal mounting apertures are spaced to match a spacing of a wall stud and are sized to accept a fastener used to mount the frame to the vertical wall, and wherein the forward projections of the top and bottom segments are attached to and extend horizontally from the base portions of the top and bottom segments, and two side segments extending from the top segment to the bottom segment and spaced apart from each other, wherein each of the two side segments comprise a plurality of vertical mounting apertures sized to accept the fastener to mount the frame to the vertical wall; and at least one rectangular panel pivotally and removeably attachable to the open rectangular frame by a mounting rail, wherein the mounting rail is attachable to a back side proximal to a distal edge of the at least one rectangular panel and includes a top pin and a bottom pin, wherein the top pin of the mounting rail is positionable within one of the plurality of pivot apertures in the forward projection of the top segment and the bottom pin of the mounting rail is positionable within an aligned one of the plurality of pivot apertures in the forward projection of the bottom segment, wherein the at least one rectangular panel is rotatable about a vertical axis through at least 120 degrees of rotation.

2. The tool rack of claim 1, wherein the at least one rectangular panel is rotatable about the vertical axis through at least 140 degrees of rotation.

3. The tool rack of claim 1, wherein the frame and the mounting rail each comprise powder coated steel.

4. The tool rack of claim 1, wherein the at least one rectangular panel comprises a plurality of regularly spaced peg holes.

5. The tool rack of claim 4, further comprising:

at least two attachment means, wherein the mounting rail is attachable to the back side proximal to the distal edge of the at least one rectangular panel by positioning each of the at least two attachment means through an attachment aperture in the mounting rail and an aligned one of the plurality of regularly spaced peg holes in the rectangular panel.

6. The tool rack of claim 5, wherein the mounting rail is removeably attachable to the at least one rectangular panel using the at least two attachment means which comprise a nut and bolt set.

7. The tool rack of claim 1, wherein the at least one rectangular panel comprises a single sheet of peg-board material.

8. The tool rack of claim 1, wherein the top pin of the mounting rail is longer than the bottom pin of the mounting rail.

9. The tool rack of claim 1, wherein the forward projections of the top and bottom segments extend horizontally beyond a horizontal profile of the side segments.

10. The tool rack of claim 4, further comprising:

at least one tool mounting element positionable within one or more of the plurality of regularly spaced peg holes and configured to hold a tool.

11. A tool rack kit comprising:

the tool rack of claim 4; and a plurality of fasteners useful to mount the open rectangular frame flush with the vertical wall.

12. The tool rack kit of claim 11, further comprising:

at least one tool mounting element positionable within one or more of the plurality of regularly spaced peg holes and configured to hold a tool.

13. A tool rack kit comprising:

the tool rack of claim 6;

a plurality of fasteners useful to mount the open rectangular frame flush with the vertical wall; and a plurality of tool mounting elements for releasably attaching a tool to the at least one panel.

14. A wall mounted tool rack assembly comprising:

an open rectangular frame mountable flush with a vertical wall, the frame comprising:

a top segment and a bottom segment each having a base portion comprising at least two horizontal mounting apertures and a forward projection comprising a plurality of pivot apertures, wherein the forward projections of the top and bottom segments are attached to and extend horizontally from the base portions of the top and bottom segments, and two side segments extending from the top segment to the bottom segment and spaced apart from each other, each side segment comprising a plurality of vertical mounting apertures; and at least one mounting rail, wherein the at least one mounting rail includes a top pin and a bottom pin, wherein the top pin is longer than the bottom pin and is positionable within one of the plurality of pivot apertures in the forward projection of the top segment and the bottom pin is positionable within an aligned one of the plurality of pivot apertures in the forward projection of the bottom segment, and wherein the forward projections of the top and bottom segments extend horizontally beyond a horizontal profile of the side segments, and wherein the at least two horizontal mounting apertures are spaced to match a spacing of a wall stud and are sized to accept a fastener used to mount the frame to the vertical wall.

15. The wall mounted tool rack assembly of claim 14, wherein the open rectangular frame and the at least one mounting rail comprise powder coated steel.

16. The wall mounted tool rack assembly of claim 14, further comprising:

at least two rail attachment means, wherein the at least one mounting rail is attachable to a back side proximal to a distal edge of the panel by positioning each of the at least two rail attachment means through an attachment aperture in the at least one mounting rail and an aligned hole in the panel.

17. The wall mounted tool rack assembly of claim 14, further comprising:

at least one panel, wherein the at least one panel comprises a single sheet of peg-board material which is attachable to the at least one mounting rail along a back side of the panel proximal to a distal edge thereof.

18. A wall mounted tool rack comprising:

an open rectangular frame mountable flush with a vertical wall, the frame comprising:

a top segment and a bottom segment each having a base portion comprising at least two horizontal mounting apertures and a forward projection comprising a plurality of pivot apertures, wherein the forward projections of the top and bottom segments are attached to and extend horizontally from the base portions of the top and bottom segments, and two side segments extending from the top segment to the bottom segment and spaced apart from each other, each side segment comprising a plurality of vertical mounting apertures;

at least one panel comprising a plurality of regularly spaced peg holes;

at least one mounting rail attachable to the at least one panel, the at least one mounting rail including a top pin and a bottom pin; and at least two rail attachment means, wherein the at least one mounting rail is attachable to a back side proximal to a distal edge of the at least one panel by positioning the at least two rail attachment means through an attachment aperture in the at least one mounting rail and an aligned peg hole in the at least one panel, wherein the top pin is longer than the bottom pin and is positionable within one of the plurality of pivot apertures in the forward projection of the top segment and the bottom pin is positionable within an aligned one of the plurality of pivot apertures in the forward projection of the bottom segment, and wherein the at least two horizontal mounting apertures are spaced to match a spacing of a wall stud and are sized to accept a fastener used to mount the frame to the vertical wall, and wherein the forward projections of the top and bottom segments extend horizontally beyond a horizontal profile of the side segments so that the at least one panel is rotatable about a vertical axis through at least 120 degrees of rotation.

19. The wall mounted tool rack of claim 18, wherein the at least one panel is rotatable about the vertical axis through at least 140 degrees of rotation.

* * * * *